US005329900A

United States Patent [19]

Dye

[11] Patent Number: 5,329,900

[45] Date of Patent: Jul. 19, 1994

[54] ROTARY INTERNAL COMBUSTION ENGINE

[75] Inventor: Anthony O. Dye, Cambridge, England

[73] Assignee: Surgevest Limited, Cambridge, England

[21] Appl. No.: 855,027

[22] PCT Filed: Nov. 5, 1990

[86] PCT No.: PCT/GB90/01692

§ 371 Date: Jun. 5, 1992

§ 102(e) Date: Jun. 5, 1992

[87] PCT Pub. No.: WO91/06747

PCT Pub. Date: May 16, 1991

[30] Foreign Application Priority Data

Nov. 6, 1989 [GB] United Kingdom ..... 8925018

[51] Int. Cl.[5] ..... F02B 53/00

[52] U.S. Cl. ..... 123/238

[58] Field of Search ..... 123/235, 238; 418/183, 418/191

[56] References Cited

U.S. PATENT DOCUMENTS

| | | | |
|---|---|---|---|
| 3,203,406 | 8/1965 | Dettwiler | 123/238 |
| 4,321,897 | 3/1982 | Pelekis | 123/238 |
| 4,848,295 | 7/1989 | Loran et al. | 123/238 X |
| 4,971,002 | 11/1990 | Le | 123/238 |

FOREIGN PATENT DOCUMENTS

| | | | |
|---|---|---|---|
| 622650 | 3/1963 | Belgium | 123/238 |
| 734691 | 8/1943 | Fed. Rep. of Germany | 123/235 |
| 2417074 | 10/1975 | Fed. Rep. of Germany . | |
| 3018638 | 12/1981 | Fed. Rep. of Germany . | |
| 3601034 | 8/1987 | Fed. Rep. of Germany | 123/238 |
| 2017579 | 5/1970 | France . | |
| 2449786 | 9/1980 | France . | |
| 306234 | 12/1988 | Japan | 123/238 |

*Primary Examiner*—Michael Koczo
*Attorney, Agent, or Firm*—Longacre & White

[57] ABSTRACT

The invention relates to an internal combustion engine having separate rotary compression and expansion sections and a combustion chamber (16) having valved inlet and outlet ports (21,22) communicating with the compression and expansion chambers respectively. Each section is a rotary device comprising a first rotor (14*b*) rotatable about a first axis (11) and having at its periphery a recess (R) bounded by a curved surface; and a second rotor (14*a*) counter-rotatable to the first rotor (14*b*) about a second axis (10), parallel to the first axis (11), and having a radial lobe (P) bounded by a curved surface, the rotors intermeshing whereby, on rotation thereof, a transient chamber of progressively increasing (expansion section) or decreasing (compression section) volume is defined between them. The rotors (14*a*,14*b*) are rotatable at a relative speed ratio, preferably 2:3, and are contoured such that during passage of the lobe (P) through the recess (R), the recess surface is continuously swept, by both a tip (17) of the lobe (P) and a movable location (18) on the lobe (P) which progresses along the lobe surface, to define the transient chamber.

12 Claims, 10 Drawing Sheets

ROTARY INTERNAL COMBUSTION ENGINE

This invention relates to a rotary internal combustion engine in which compression and expansion take place in different chambers.

GB-A-1505853 (published Mar. 30, 1978) discloses a rotary engine having a pair of intermeshing rotors having truncated cycloidal lobes driven by intermeshing gears to compress the fuel/air mixture in combustion zones formed by the intermeshing rotors. The intermeshing rotors are mounted on shafts geared together in a 1:1 speed ratio. The compression/expansion achieved by the action of the two rotors does not provide a completely swept volume in which the volume of the charge remaining entrapped between the rotors is reduced to a minimum clearance volume. Compression, combustion and expansion take place in the same cylinder.

DE-A-3626084 (published Mar. 19, 1987) discloses a rotary engine (FIG. 5) in which compression, combustion and expansion take place in different chambers. The compression and expansion sections are of essentially the same construction but differ in the location of the inlet ports and outlet ports. Each consists of a pair of rotors having respective opposed sealing vanes wiping the surface of the cylinder. The rotors have cut-out portions adjacent the vanes to receive the vane of the other rotor in the vicinity of the point of contact of the rotors. In one rotor of each pair, the cut outs permit gas flow through an inlet (expansion section) or outlet (compression section) which is otherwise closed by the rotor. In one illustrated embodiment (FIG. 3), the rotors are toothed but the intermeshed teeth do not serve to define the compression chamber.

GB-A-1098854 (published Jan. 10, 1968), GB-A-1574549 (published Sep. 10, 1980), U.S. Pat. No. 3,902,465 (Sep. 2, 1980) and U.S. Pat. No. 4,476,826 (Oct. 16, 1984) all describe rotary engines in which combustion takes place in a separate chamber located between compression and expansion chambers.

U.S. Pat. No. 3,472,445 (published Oct. 14, 1969) and GB-A-1304394 (Jan. 24, 1973) both disclose air compressors having intermeshing counter-rotating lobed rotors contained within a housing. The lobes of the rotors sweep the housing wall to provide the main compression effect but a transient chamber of reducing volume is formed between the rotor lobes over a part of their rotational path to exhaust the compressed charge. Usually, the rotors have equal numbers of lobes and rotate at the same speed. However, U.S. Pat. No. 3,472,445 illustrates (Figure XXI) an arrangement in which a smaller rotor has a single lobe and a larger rotor has two lobes and the rotors rotate at a 2:1 rotational speed ratio. GB-A-1304394 refers to the possibility of having different numbers of lobes and/or different diameters and, in the case of rotors with different number lobes, to the use of appropriate transmission ratios to drive the rotors at appropriate different speeds.

The requirements for the compressor section of an internal combustion engine are very different from those of an air compressor. In particular, it is desirable that there should be substantially no pre-compression in the compressor section and that delivery/receipt of the charge should commence substantially simultaneously with compression. Surprisingly, it has been found that use of intermeshing counter-rotating lobed rotors of the kind disclosed in U.S. Pat. No. 3,472,445 or GB-A-1304394 in internal combustion engines substantially improves the efficiency of engines of the kind to which the present invention relates.

According to the present invention, there is provided an internal combustion engine comprising separate rotary compression and expansion sections and a combustion chamber having valved inlet and outlet ports communicating with said compression and expansion sections respectively, characterised in that each of said compression and expansion sections is a rotary device comprising: a first rotor rotatable about a first axis and having at its periphery a recess bounded by a curved surface; and a second rotor counter-rotatable to said first rotor about a second axis, parallel to said first axis, and having a radial lobe bounded by a curved surface, said rotors intermeshing whereby, on rotation thereof, a transient chamber of progressively increasing (expansion section) or decreasing (compressor section) volume is defined between said surfaces, said surfaces being contoured such that, during passage of said lobe through said recess, said recess surface is continuously swept, by both a tip of said lobe and a movable location on said lobe which location progresses along both said lobe surface and said recess surface, to define said transient chamber, the respective first and second rotors of the sections being coupled for rotation. Suitably said first rotors cf the sections rotate about a common first axis, and said second rotors of the sections rotate about a common second axis.

Unless the first rotors are shaped to provide gaseous fluid communication with the existent chamber at or near its minimum volume configuration by, for example, a chamfered edge or groove, a gaseous fluid communication port will be provided in one of the first rotors to permit said communication.

Usually, the rotors will be of uniform radial cross-section along their axial lengths and said recess and lobe will extend straight or helically in the axial direction. Suitably, the rotors are mounted in bearings in static end walls which close the respective ends of the recess to delimit the axial length of the transient chamber formed between the intermeshing rotors. However, the recess can terminate short of the axial ends of the first rotor so that said chamber is delimited by the end surfaces of the recess.

Mechanical seals can be provided at the tip and/or ends of the lobe but it usually will be sufficient to machine or otherwise form the relevant juxtaposed surfaces with a restricted fluid clearance.

When the rotary device is the compression section, the rotors will be driven from the rotors of the expansion section and the transient chamber will decrease in volume as the lobe passes through the recess. Air can be provided in the transient chamber from the engine housing and subsequently fuel injected or otherwise delivered directly into the existent transient chamber. Suitably, the outlet means for the compressed gaseous fluid from the transient chamber comprises a chamfered groove or a passage in the first rotor which communicates between the recess therein and the opening in the end wall of said rotor. The location of the inlet to the passage in the recess usually will be in a zone corresponding to the minimum chamber volume and will permit flow of gaseous fluid from the transient chamber over at least substantially its entire existence.

When the rotary device is the expansion section, the transient chamber increases in volume as the lobe passes through the recess and the rotors will be caused to rotate by gaseous fluid pressure in the existent transient chamber. Usually, said gaseous fluid will pass through a chamfered groove or a passage in the first rotor communicating between the opening in the end wall thereof and the recess. The location of the outlet of the passage in the recess usually will be in a zone corresponding to the minimum chamber volume and will permit flow of gaseous fluid into the transient chamber over at least substantially its entire existence.

Preferably, the speed of rotation of the first, recessed, rotor is lower than the speed of rotation of the second, lobed, rotor by a ratio, less than 1:1, of whole numbers.

It also is preferred that the first and second rotors have respectively equiangularly spaced recesses and lobes in the same ratio of number of recesses to number of lobes as the speed ratio of the lobed rotor to the recessed rotor.

In a presently especially, preferred embodiment the first rotor has three equiangularly disposed recesses, and the second rotor has two diametrically opposed lobes, and the ratio of their speeds of rotation is 2:3. If desired, two or more first, recessed, rotors can intermesh with the same second, lobed, rotor or, more usually, two or more second, lobed, rotors can intermesh with the same first, recessed rotor.

Each rotary device includes a valve operating in appropriate timing, and in a convenient manner the recess can have as said opening in the first rotor end surface a radially offset port ie. at a smaller radius than the maximum radius of the recess.

For increased compression, or increased work upon expansion, as the case may be, the rotors may be enclosed in a housing having first and second arcuate recesses which are coaxial respectively with the first and second rotors and which form a sliding seal therewith, such that for a portion of a turn before and/or after the lobe passes through the recess in the first rotor, there is defined between the rotors and the housing an additional transient chamber of progressively increasing or decreasing volume which communicates with the transient chamber between the rotors.

The internal combustion engine of the invention can be adapted for operation with all types of gaseous or liquid fuels. The fuel can be pre-mixed with air and the fuel/air mixture formed in or admitted to the compressor section. Alternatively, the fuel can be injected directly into the combustion chamber. In the case of a spark-ignition engine, an ignition device is disposed in the combustion chamber. In the case of a compression-ignition engine, such as a diesel engine, the air flow during compression can be directed by a suitably shaped inlet port for optimum mixing with the injected fuel stream.

The following is a description by way of example only and with reference to the accompanying drawings of presently preferred embodiments of the invention. In the accompanying drawings:

FIG. 1 is a schematic section of part of an internal combustion engine of the invention, taken on a plane passing through the respective axes of the rotors of compression and expansion sections thereof, each of which sections is a rotary device in accordance with the present invention;

FIGS. 2*a*, 2*b* and 2*c* are respectively schematic diametral sections of the interacting rotors of the compression section showing successive stages in the compression cycle of the engine;

FIGS. 3*a*, 3*b* and 3*c* are respectively schematic diametral sections of the interacting rotors of the expansion section showing successive stages in the expansion cycle of the engine;

Figure 2A:
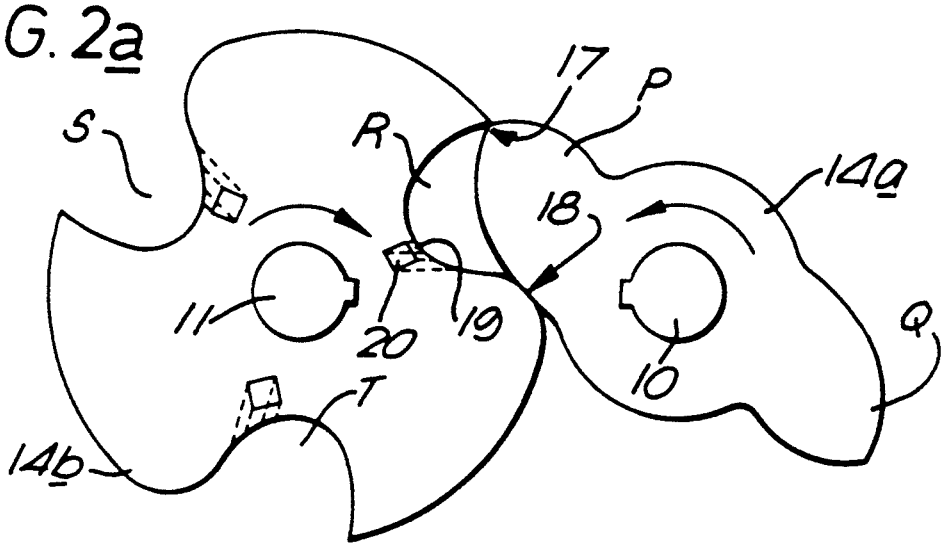
Figure 2B:
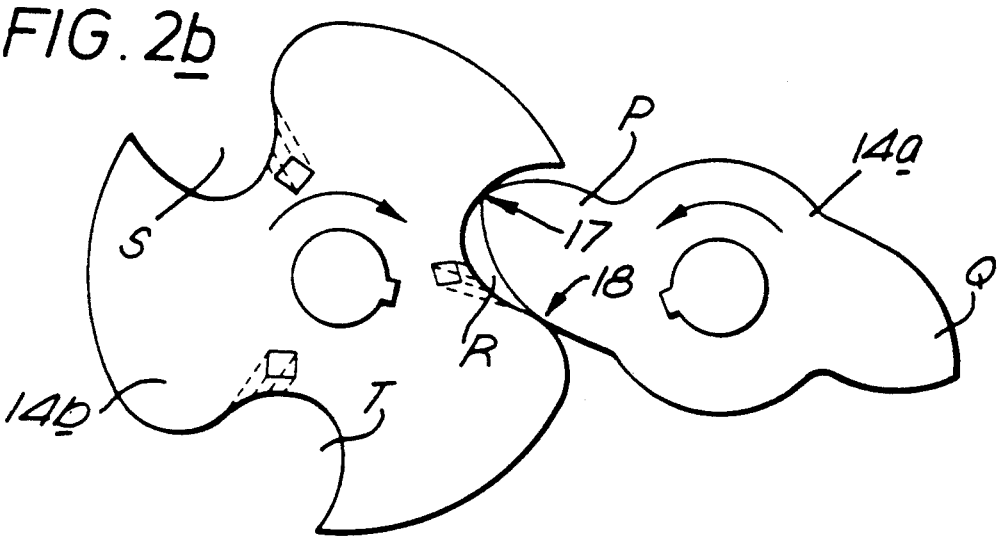
Figure 2C:
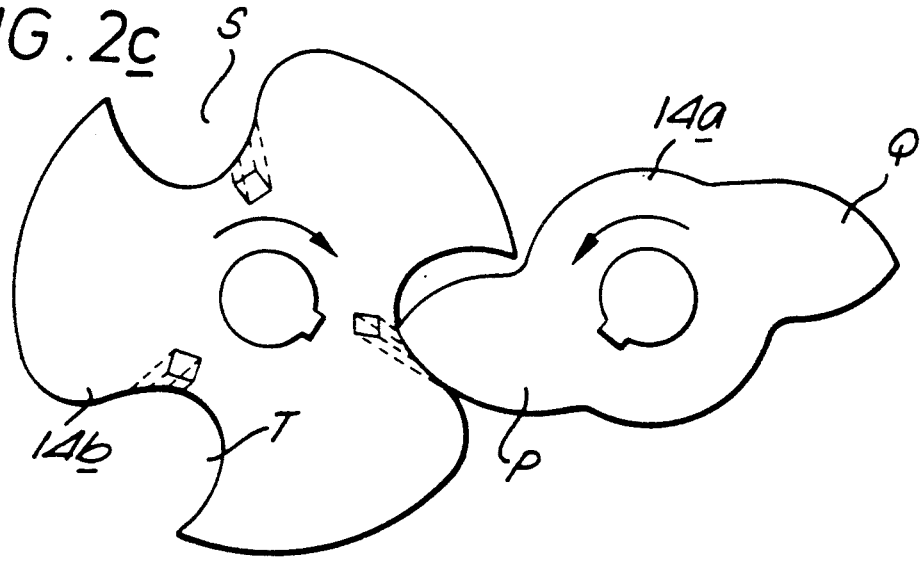
Figure 7:
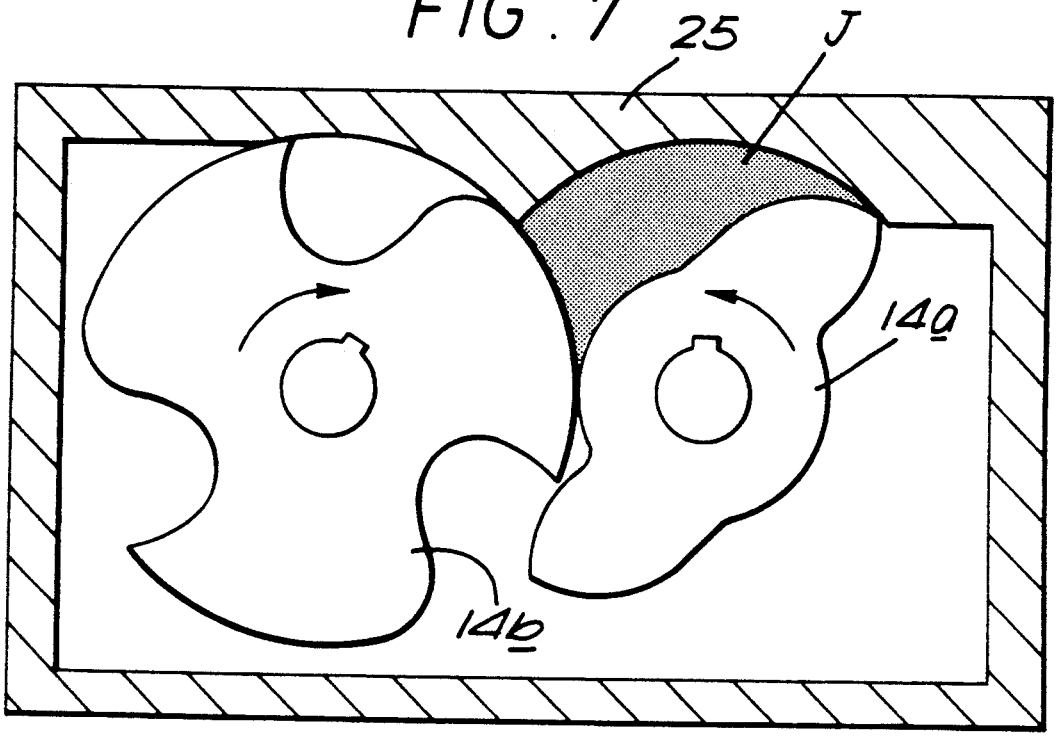
FIG. 7 is a view, corresponding to that of FIGS. 2*a*, 2*b* and 2*c*, of a modification in which a housing surrounding the compression rotors is shaped to coact with the rotors in the compression cycle.
Figure 8:
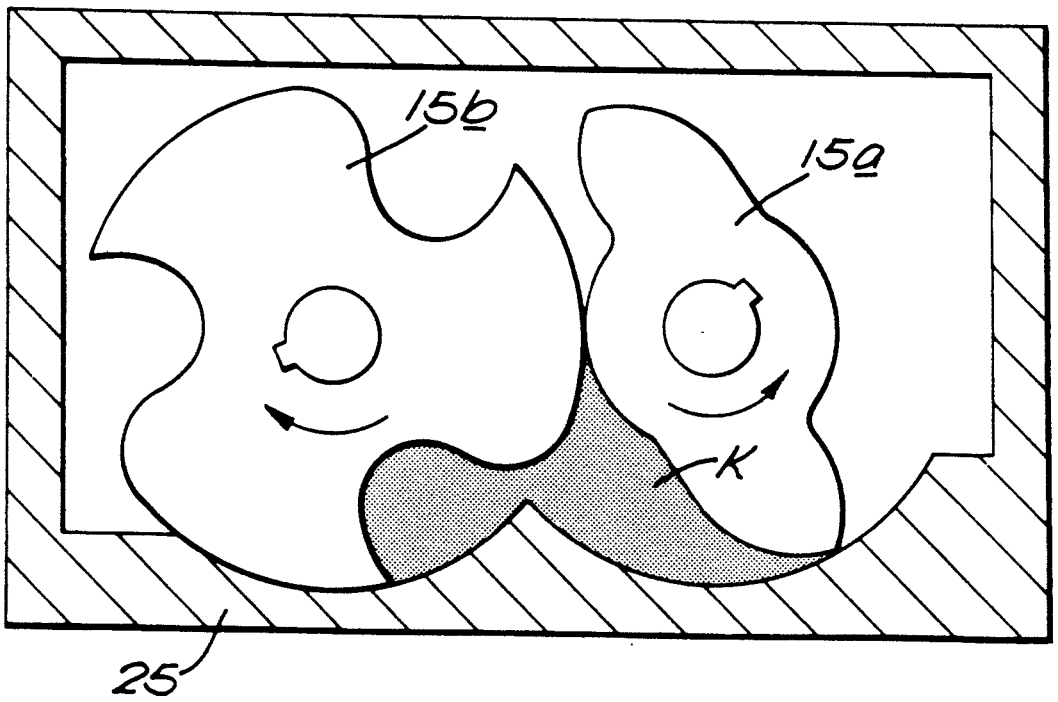
Figure 10:
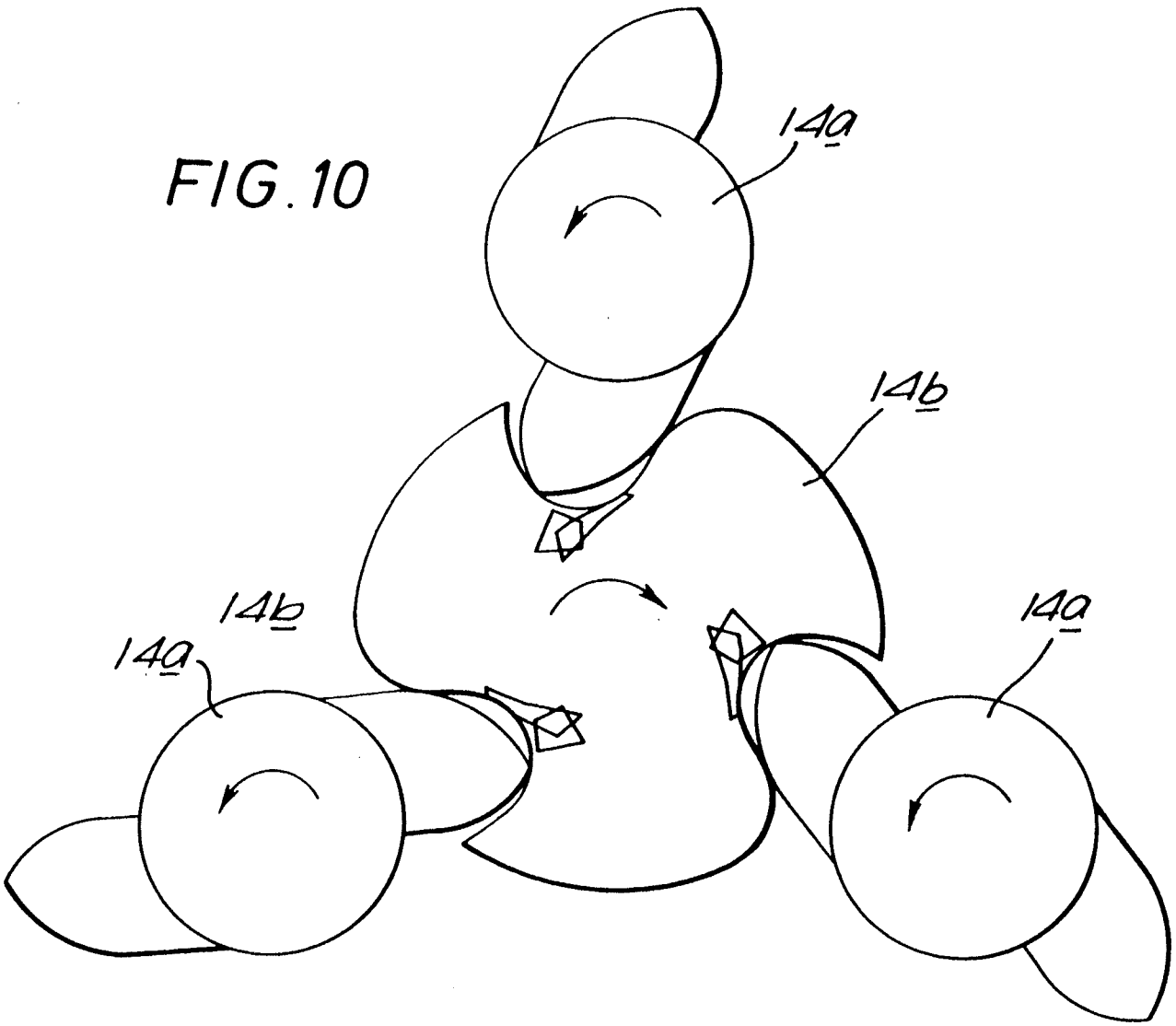
Figure 11:
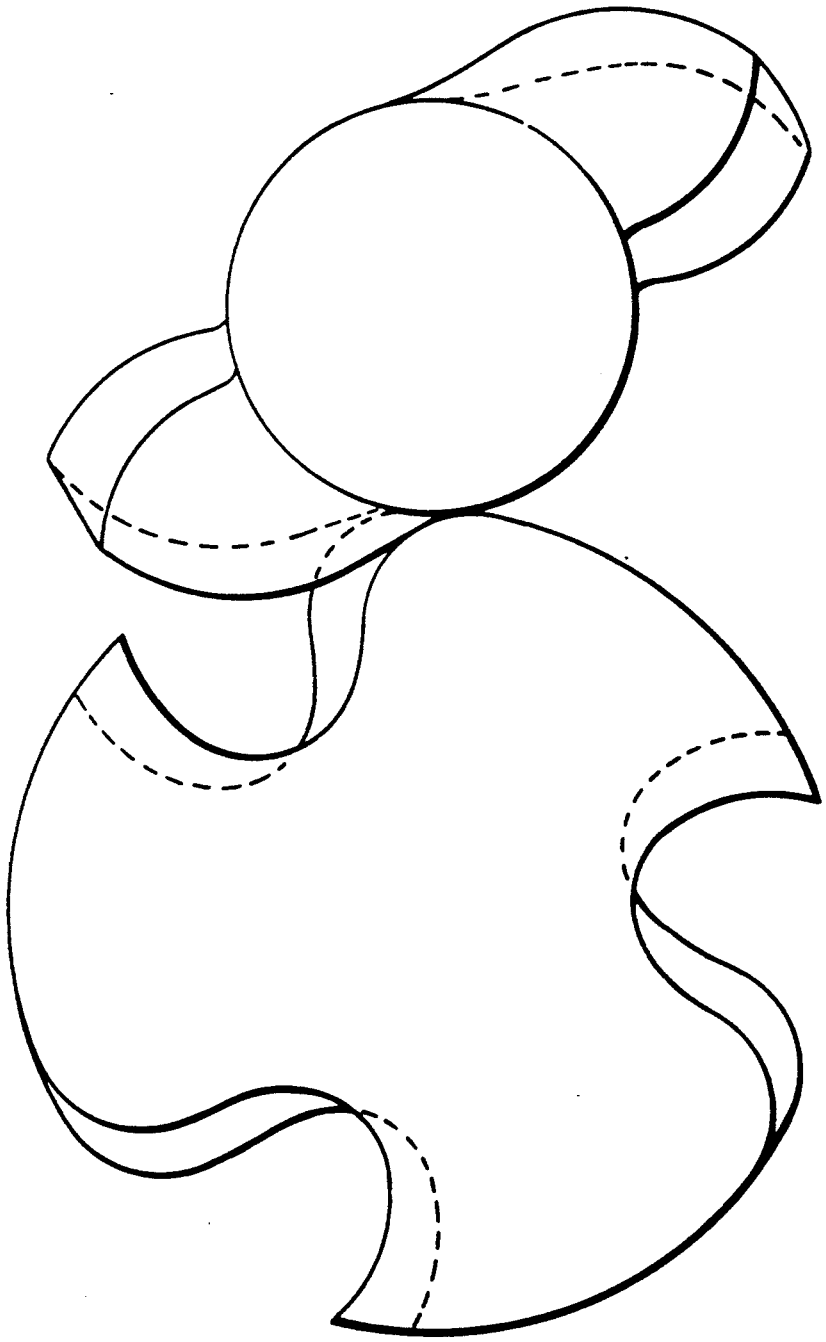

FIG. 8 is a similar view to that of FIG. 7 of a corresponding modification to the housing surrounding the expansion rotors to coact with the rotors in the expansion cycle; and FIGS. 9*a* to 9*f* show respectively schematic diametral sections of the interacting rotors of the compression section showing successive stages in the compression cycles of a modified version of the engine, and provide further explanation of the stages shown in FIGS. 2*a*, 2*b*, and 2*c*;

FIG. 10 shows a modified embodiment having more than one lobed rotor in connection with a single recessed rotor; and FIG. 11 shows rotors of the form with helical shape in the axial direction.

Figure 1:
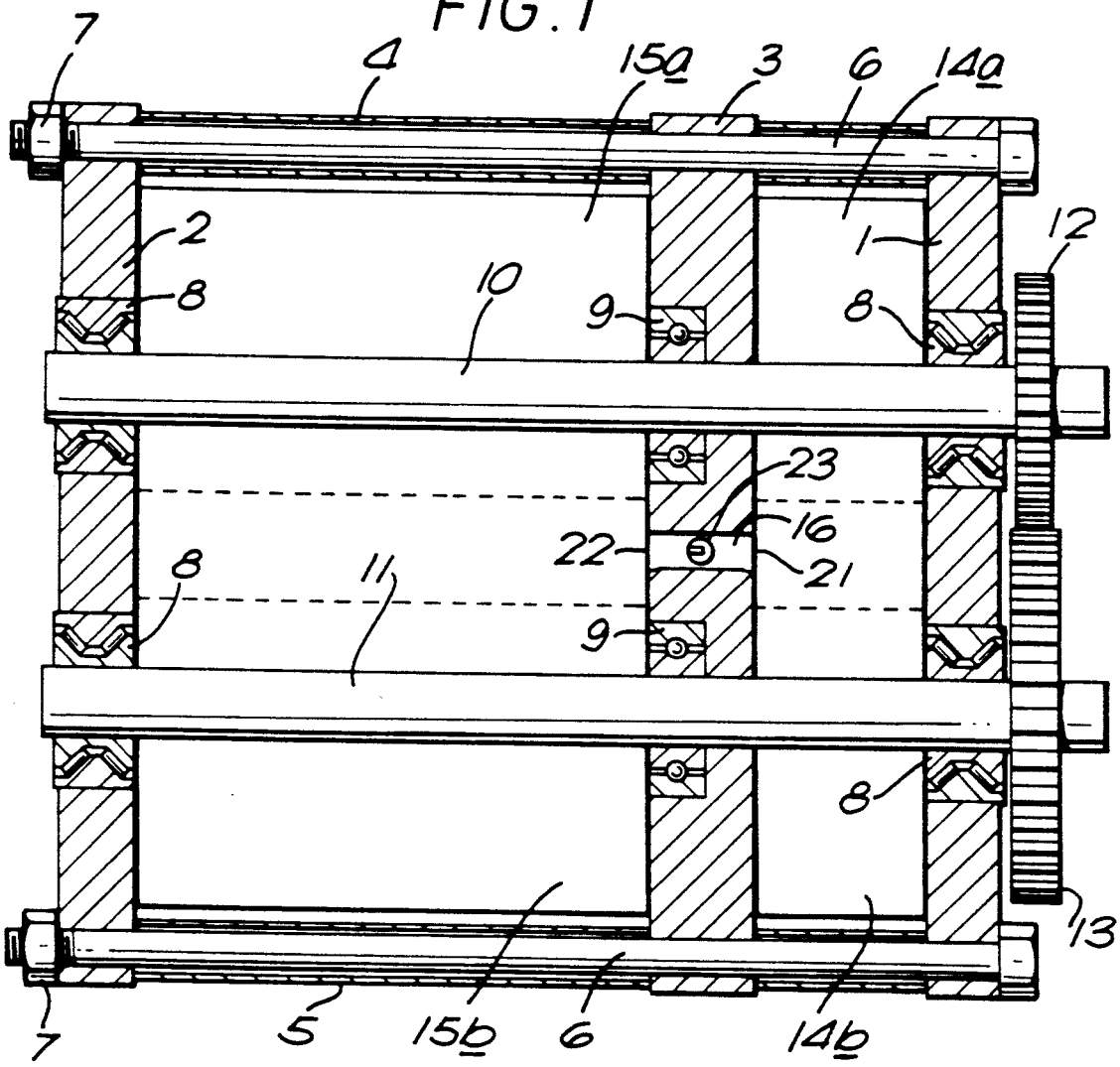

Referring to FIG. 1, the engine comprises a pair of end walls 1 and 2, axed a parallel intermediate wall 3 all secured in a fixed assembly by means of spacer sleeves 4 and 5, and a plurality of bolts 6 with nuts 7. In each of the end walls 1, 2 there are roller bearings 8, and in the intermediate wall 3 there are ball bearings 9, to carry a first shaft 11 and a second shaft 10 parallel to the first shaft. The second shaft 10 carries at one end a keyed gear pinion 12, and the first shaft 11 carries at the same end a keyed pinion 13, the two pinions meshing and having a speed ratio of 2:3 as between pinion 13 and pinion 12.

Each of the shafts 10 and 11 carries respective keyed compression rotors 14*a*, 14*b* (shown in FIGS. 2*a* to 2*c*) and keyed expansion rotors 15*a*, 15*b* (shown in FIGS. 3*a* to 3*c*), each forming a substantially gas-tight sliding fit between the walls 1 and 3, and 2 and 3 respectively. housing (not shown) is disposed about the assembly so as to provide an intake chamber about the compression rotors, and an exhaust chamber about the expansion rotors.

In the intermediate wall 3, and communicating with both side faces thereof, is a combustion chamber 16, the shape of which is explained in more detail below with reference to FIGS. 4, 5, and 6.

The compression rotors 14*a*, 14*b* and compression phase are now described in detail with reference to FIGS. 2*a*, 2*b* and 2*c*. In FIG. 2*a*, lobed rotor 14*a* is the faster rotor, and recessed rotor 14*b* is the slower rotor. Said rotors together constitute a rotary device of the invention. Rotor 14*a* has radial lobes "P" and "Q" which are identical in shape and which are shaped in a computer-determined manner to fit into and co-operate with recesses "R", "S" and "T" of rotor 14*b*.

A gaseous working fluid, e.g. a fuel/air mixture, or air alone when a fuel injection system is used, is provided in the housing surrounding the rotor 14b and fills the recesses "R", "S" and "T" therein. The compression cycle commences when the two rotors 14a and 14b are in the position shown in FIG. 2a. In this position, a charge of the working fluid is entrapped between the rotors, with limited escape only possible via the restricted gas clearances at the tip 17 and heel 18 of the rotor 14a. Compression of the charge, in the recess "R", is effected as the rotors proceed to the position of FIG. 2b, when the entrapped volume between the rotors has been diminished by the displacement action of the moving rotors. As the charge of gaseous working fluid is compressed, it is delivered via a passage 19 in the rotor 14b which terminates in a rotor port 20 disposed in the end surface of the rotor which faces the internal wall 3. During the whole of the compression phase, this rotor port 20 communicates with an entry port 21 (also referred to as an outlet port) of the combustion chamber 16, in the intermediate wall 3.

This sequence whereby a charge of working fluid is compressed and delivered to the combustion chamber is further exemplified in FIGS. 9a to 9f in such a way that the alignment between the rotor port 20 and the combustion chamber port 21 are more clearly shown. FIGS. 9a to 9f relate to an embodiment such as that shown in FIGS. 7 and 8 in which the housing 25 enables the commencement of entrapment to occur at an earlier stage before the lobe P of rotor 14a starts to enter the recess R of rotor 14b. This embodiment also incorporates a rotor 14b in which the passage 19 is replaced by a chamfered groove in the recess, whose outer edges form the port 19. In such a embodiment, the sequence of events is described by reference to each of the FIGS. 9ato 9f in which each successive Figure shows further progressive rotation of the rotors 14a and 14b.

Figure 9A:
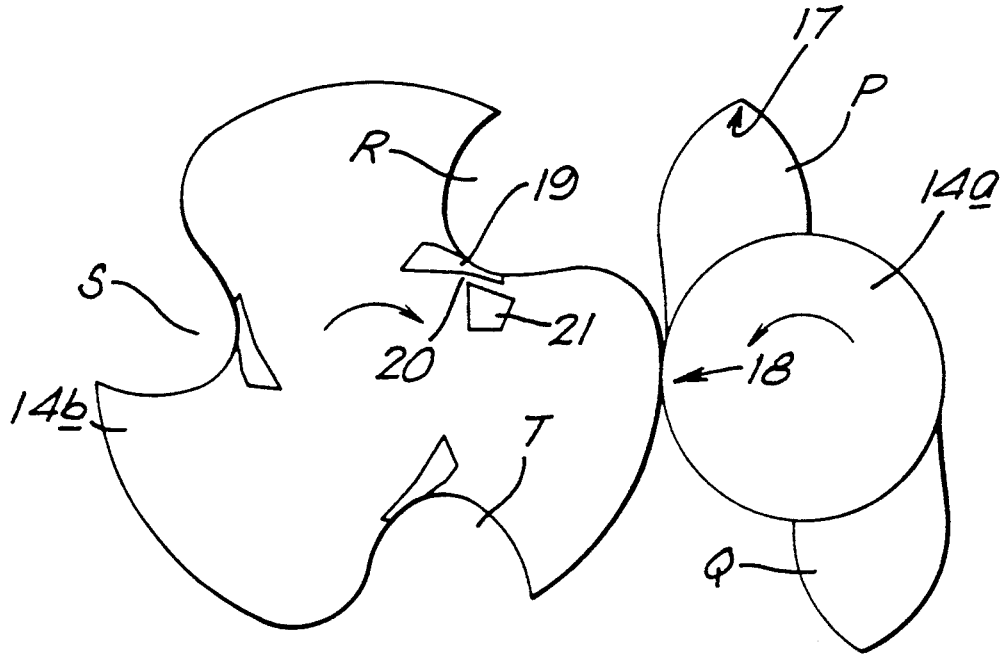

FIG. 9a shows the position just before the tip 17 of the lobe P and the leading outer edge of recess R mater in minimal clearance with the housing 25 (not shown) i.e. before the position shown in FIG. 7. In this position, the combustion chamber port 21 is completely covered by the end wall of the rotor 14b. The working fluid surrounds rotors 14a and 14b and no charge is entrapped.

Figure 9B:
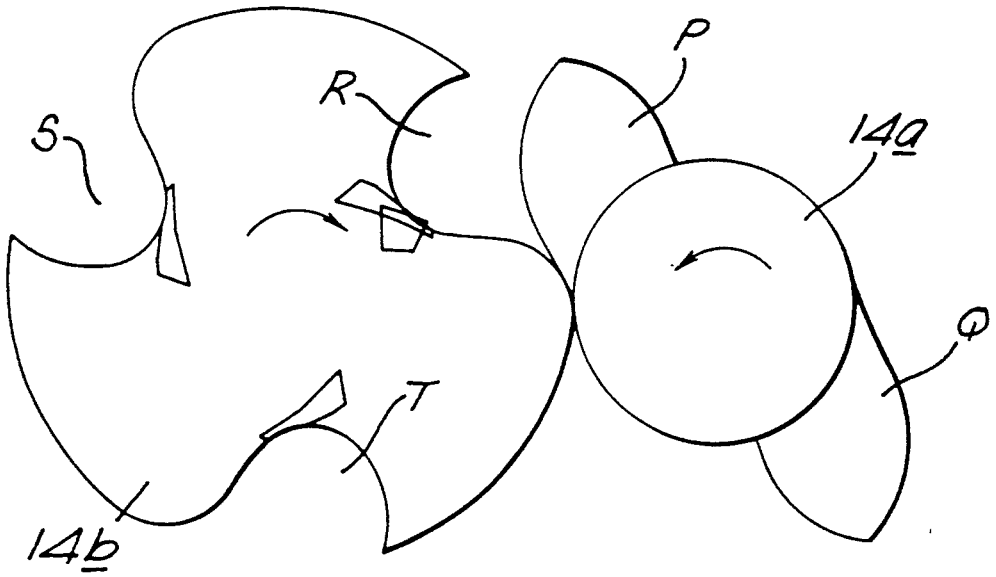

FIG. 9b shows the position shortly after entrapment of the working fluid charge has occurred and compression of the charge has begun within the bounds formed by the lobes P, recess R, and housing 25 (not shown) with limited escape only possible via the restricted gas clearance at the periphery of the rotors and the heel 18 of rotor 14a. The leading edge of the rotor port 19 has now also crossed the upper edge of the port 21 thus creating a passage through which the working fluid begins to flow into the combustion chamber.

Figure 9C:
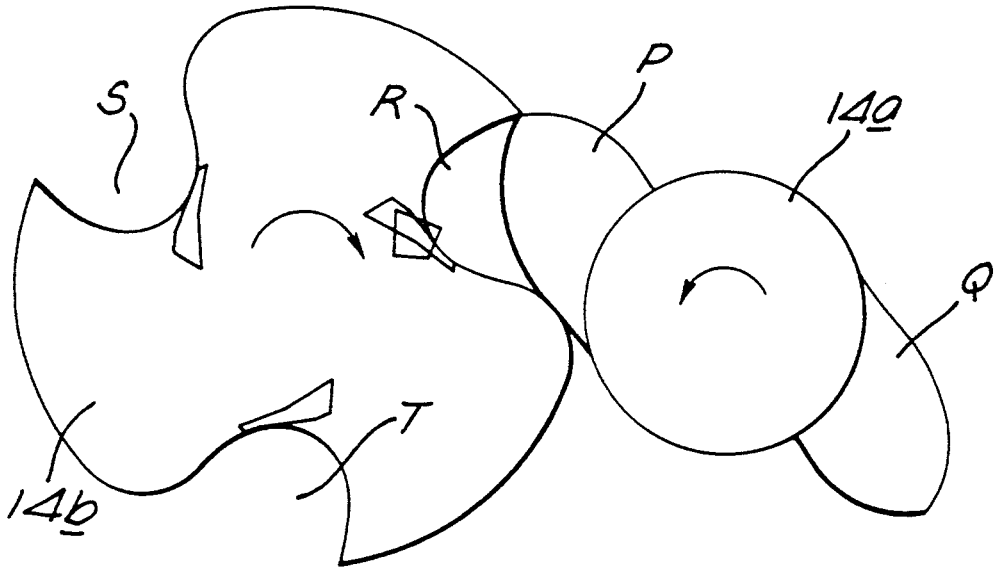

FIG. 9c shows the rotors having advanced to a position where the tip 17 of the lobe P is just starting to interact with the surface of the recess R. At this point, the clearance housing 25 (not shown) ceases to act further to contain the charge and compression is effected thereafter by progressive displacement of the volume of recess R by lobe P. At this stage, the rotor port 20 reaches an alignment with the combustion chamber port 21 such that the flow area through both ports reaches a near-maximum value.

Figure 9D:
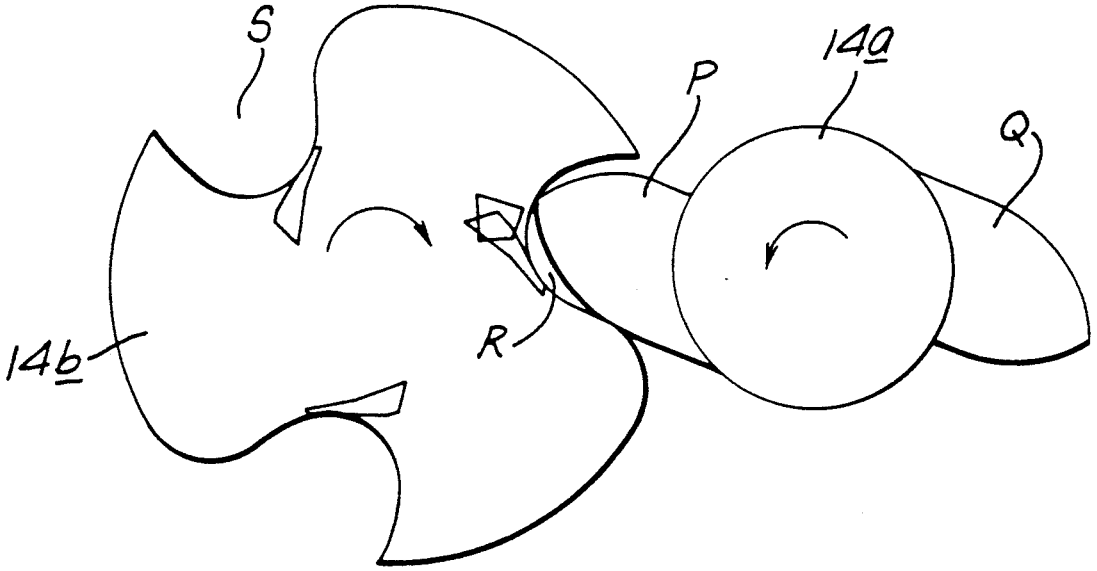

FIG. 9d shows a later position of compression effected by further displacement of the volume of recess R by lobe P. The alignment of the ports 20 and 21 shows that the flow area through the ports has passed the maximum and is now decreasing with further rotation.

Figure 9E:
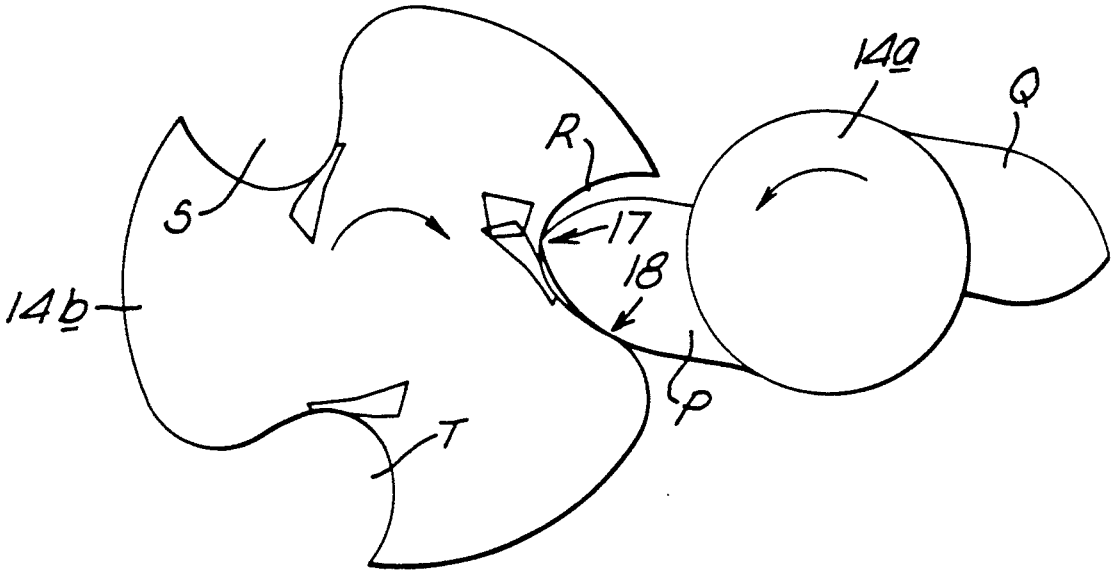

FIG. 9e shows the position where displacement of the working fluid charge from the recess R is almost complete and the charge is reduced to almost its minimum value i.e. that of the combustion chamber. The alignment of the ports 20 and 21 still permits flow of the remaining portion of the charge in recess R, in highly compressed state, into the combustion chamber.

Figure 9F:
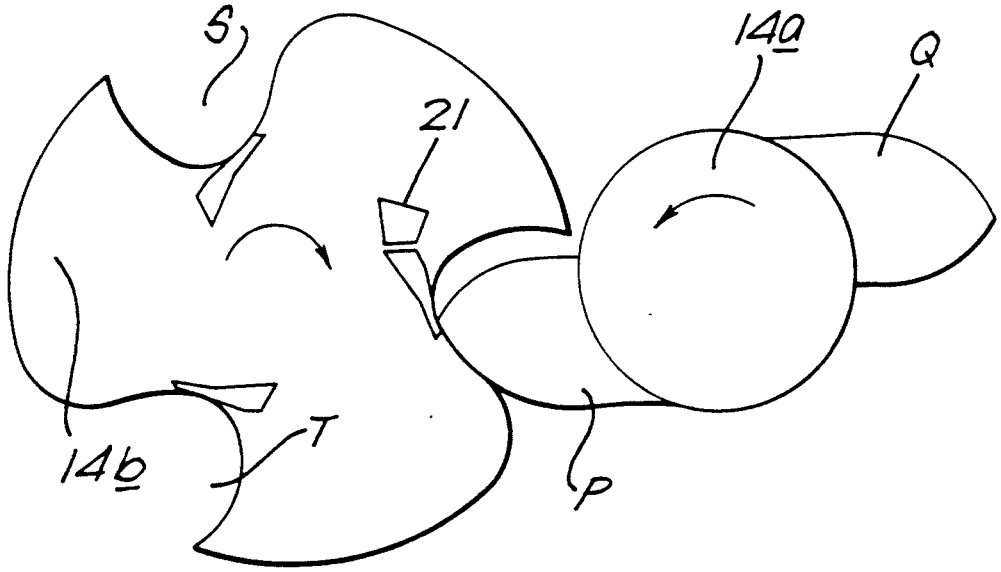

FIG. 9f shows the position of the rotors shortly after the end of the compression sequence. The trailing edge of the rotor port 20 has cleared the lower edge of the combustion chamber port 21 thus causing the charge to be sealed within the combustion chamber with minimal leakage only possible due to the close clearance between the port 21 and the end wall of the rotor 14b.

The compression phase is completed at the position of FIG. 2c, when the entrapment volume has been reduced to solely the clearance volume between the respective parts of the two rotors. At this position, the trailing edge of the rotor port 20 clears the lower edge of the stationary entry port 21, thus trapping the compressed charge in the combustion chamber 16.

In this position, only limited "leak-back" is possible, via the gas clearance between the rotor 14b and the intermediate wall 3.

The combustion chamber 16 has at its other end a delivery port 22 (also referred to as an outlet port). During the whole of the combustion phase, the delivery port 22 is closed off by the adjacent side wall of the expansion rotor 15a described in greater detail below. Thus, during the combustion phase both the entry port 21 and the delivery port 22 of the combustion chamber are effectively closed by the adjacent end surfaces of the respective rotors 14b and 15b, and in this way heat is added to the compressed charge of gaseous fluid whose volume is constrained to remain constant during the combustion phase. Assuming that a fuel/air mixture is used, ignition is obtained by means of a spark plug 23 which has its tip exposed in or to the interior of the combustion chamber 16. It will be known to those skilled in the art of internal combustion engines that fuel injection with heat-ignition can be substituted for spark ignition to provide a compression ignition version of the engine. The release of heat by the combustion of the fuel causes a substantial pressure rise to occur in the combustion chamber.

Figure 4:
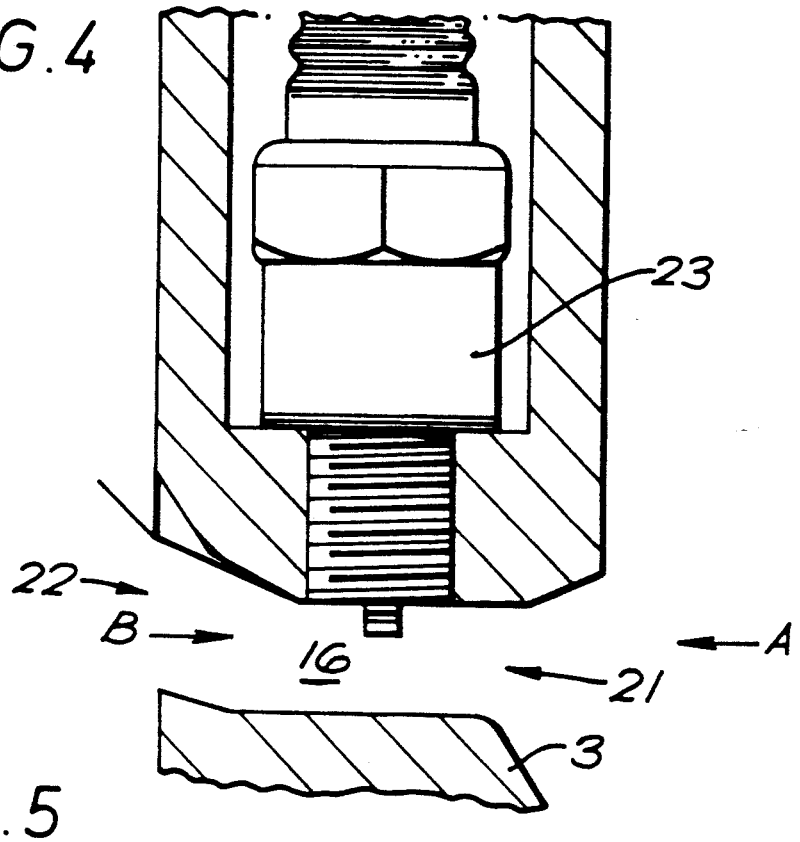
FIG. 4 is a schematic transverse section through part of the combustion chamber sections showing a spark plug.
Figure 5:
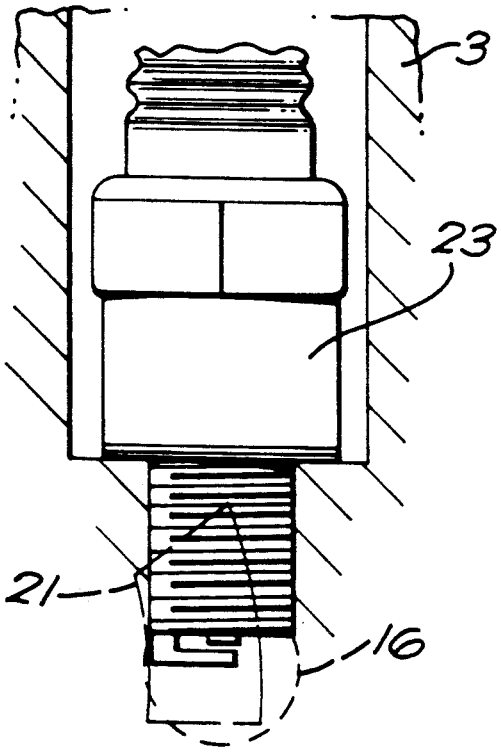
FIG. 5 is a diagrammatic representation showing an inlet end of the combustion chamber, viewed in the direction of the arrow "A" in FIG. 4.
Figure 6:
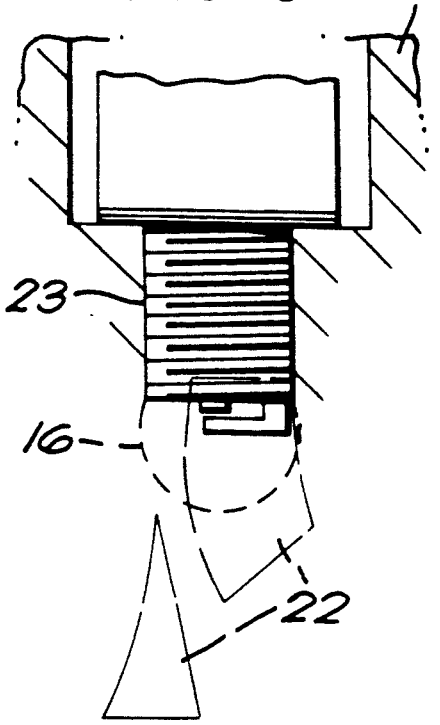
FIG. 6 is a diagrammatic representation showing an outlet end of the combustion chamber, viewed in the direction of the arrow "B" in FIG. 4.

Referring to FIGS. 4, 5 and 6, the intermediate wall 3 includes the cylindrical combustion chamber 16 which has its entry port 21 leading to it from the output rotor port 20 of the recessed compression rotor 14b, and its outlet rotor port 24 22 leading from it to an entry port of the recessed expansion rotor 15b. Within the intermediate wall 3 there is provided a space receiving the conventional spark plug 23 having its tip arranged in the combustion chamber.

Figure 3A:
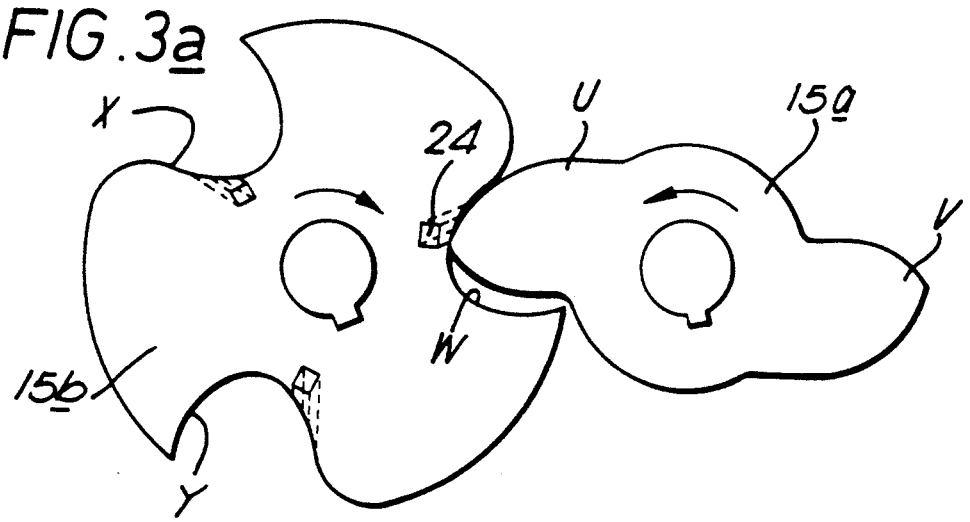
Figure 3B:
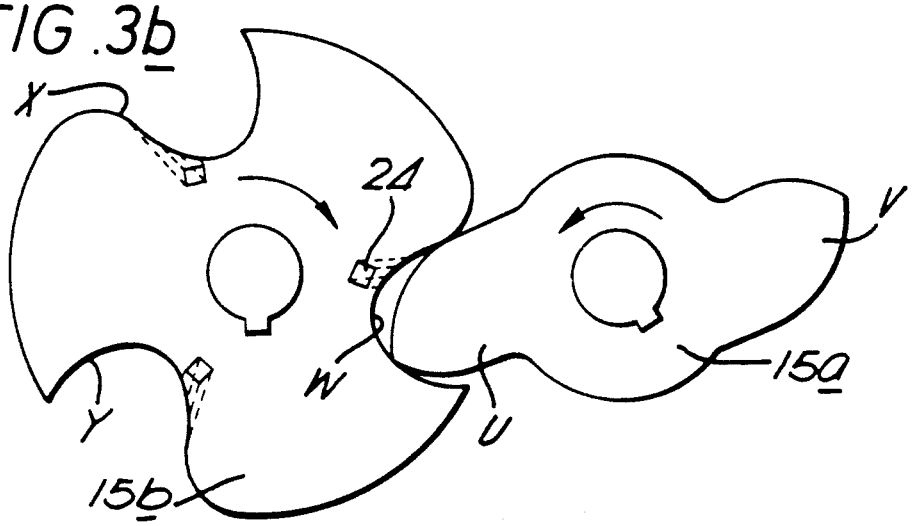
Figure 3C:
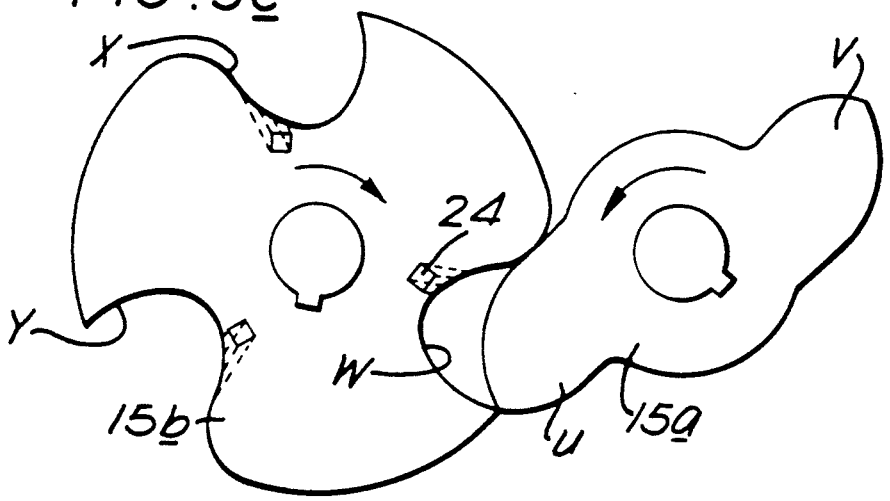

The expansion rotors and the expansion phase are now described in detail with reference to FIGS. 3a, 3b and 3c. In FIG. 3a, lobed rotor 15a is the higher speed rotor and recessed rotor 15b is the lower speed rotor. These rotors together also constitute a rotary device of the invention. Rotor 15a has radial lobes "U" and "V" which are identical in shape and which are shaped in a computer-determined manner to fit into and co-operate with recesses "W", "X" and "Y" of rotor 15b. The expansion phase commences when the two rotors reach the position of FIG. 3a. In this position, the leading edge of the rotor port 24 passes the upper edge of the delivery port 22 of the combustion chamber 16. The volume defined between the respective portions of the two rotors 15*a*, 15*b* is then placed in communication with the combustion chamber 16 which is full of gaseous fluid under very high pressure following combustion. The gaseous fluid under pressure in the volume defined between the two rotors urges the rotors to rotate into the position of FIG. 3*b*, and the process of expansion is continuous, with a resultant application of moments of force to both of the rotors to urge them to continue their rotation in the same direction. The rotors eventually reach the position of FIG. 3*c* wherein the rotors reach the limit of entrapment of the fluid, and after further rotation the exhaust gases leave the entrapment zone by the continuing displacement action of the rotors. No further energy is contributed to the rotors until the next expansion phase occurs.

The alignment of the rotor port 24 and the combustion chamber delivery port 22 during the expansion phase is analogous to the alignment of the compressor rotor port 20 and the combustion chamber charging port 21 during the compression phase. The analogous nature of the interaction of these two ports is clearly indicated by reference to the modified embodiment shown in FIGS. 9*a* to 9*f*. In order to consider the sequence of events during expansion, it is necessary to consider the rotors shown in FIGS. 9*a* to 9*f* as expansion rotors i.e. when viewed looking towards the combustion chamber delivery port 22, the direction of the rotors is reversed and the sequence of events takes place in the reverse order i.e. FIGS. 9*f* to 9*a*. Thus, FIG. 9*f* represents the position immediately prior to release of the working fluid charge at high pressure from the combustion chamber. Similarly, FIG. 9*a* represents the position at the end of the expansion phase when the combustion chamber delivery port 22 is once again fully closed. The intermediate positions representing the various stages of discharge of working fluid and its progressive action to urge continuing rotation of the rotors are represented respectively by the intermediate FIGS. 9*a* to 9*b*.

The objective of the twin rotor, positive displacement compressor/expander arrangement is to achieve an entrapped volume (ie. transient chamber) which varies between its maximum value and a near-zero volume whose minimum value is limited only by the width of the "gas clearance" between the respective parts of the two interacting rotors. In the compression mode, the arrangement provides for an entrapped volume to be defined between the leading edge of a projecting lobe of one rotor and the maximum extent of the whole of the surface of the recess in the other rotor. As the course of volume displacement proceeds, with rotation of both of the rotors in unison, entrapment "contact" (i.e. minimal clearance gap) is maintained at two points on the respective lobe and recess edges, when seen in two-dimensional cross-section. One of these points remains fixed with respect to the projecting lobe, namely its tip, e.g. 17 in FIG. 2*a*. The point of entrapment contact on the recessed rotor which corresponds to that tip moves progressively in a centripetal direction from the circumference of the recessed rotor. The other point of entrapment contact starts in the heel region of the leading edge of the projecting lobe, e.g. at 18 in FIG. 2*a*. As rotation proceeds, this second point of contact moves progressively along the leading edge of the projecting lobe towards the tip. The corresponding point of entrapment contact on the edge of the recessed rotor starts towards the circumference of the recessed rotor at its leading end, and also moves progressively along the edge towards the other point of contact.

In order for completely swept displacement to occur, the two points of entrapment move progressively closer together throughout the compression phase until they either meet or become coincident throughout a short remaining portion of edge having common curvature for both rotors.

Reference is now made to FIGS. 7 and 8 which show a modification wherein the housings of the compression and expansion sections no longer act merely as containment for incoming air or air/fuel mixture, and outgoing exhaust gases. In this modification, the housing 25 is shaped so as to mate with "sliding", i.e. minimal, clearance with the two rotors over a part of their rotating movement. FIG. 7 shows the commencement of entrapment of a volume "J" which diminishes as rotation proceeds until the gaseous fluid is reduced in volume to that shown between lobe "P" and the surface bounding recess "R" in FIG. 2*a*, so that overall a greater compression is achieved. FIG. 8 shows that the exhaust gases escaping finally from between the lobe and recess surface of FIG. 3*c* remain confined in the space "K" so that further work is extracted from the expanding gases until both rotors have moved a considerable further distance in rotation, whereafter the gases are released into the remainder of the housing. The structure and manner of interaction of the rotors, and the arrangement of the combustion chamber etc. are otherwise as described for the preceding figures.

It will be appreciated that the invention is not restricted to the particular details described above with reference to the drawings but that numerous modifications and variations can be made without departing from the scope of the invention as defined in the following claims. For example, the passages (eg 19) in the rotors can each be replaced by a corresponding chamfered groove in the recess. Generally, said grooves will be shorter than the passages which they replace and hence reduce substantially dead space in the rotary devices.

FIG. 10 shows an embodiment according to the invention in which three lobed rotors 14*a* interact with a single recessed rotor 14*b*.

FIG. 11 shows an embodiment according to the invention in which a pair of rotors interact having helical form in the axial direction.

I claim:

1. An internal combustion engine comprising separate rotary compression and expansion sections and a combustion chamber having inlet and outlet ports communicating with said compression and expansion sections respectively, in which each of said compression and expansion sections is a rotary device comprising:

a first rotor rotatable about a first axis and having at its periphery at least one recess bounded by a curved surface; and a second rotor counter-rotatable to said first rotor about a second axis, parallel to said first axis, and having at least one radial lobe bounded by a curved surface, said rotors intermeshing whereby, on rotation thereof, a transient chamber of progressively increasing (expansion section) or decreasing (compression section) volume is defined between said recesses and lobe surfaces, said surfaces being contoured such that during passage of said lobe through said recess, said recess surface is continuously swept, by both a tip of said lobe and a movable location on said lobe which location progresses along both said lobe surface and said recess surface, to define said transient chamber, the respective first and second rotors of the compression and expansion sections being coupled for rotation, and wherein the inlet and outlet ports of the combustion chamber are valved by adjacent end surfaces of the respective first rotors of the compression and expansion sections, said end surfaces having openings therein communicating with respective recesses of said first rotors.

2. An engine as claimed in claim 1, wherein said first rotors of the sections rotate about a common first axis, and said second rotors of the sections rotate about a common second axis.

3. An engine as claimed in claim 1, wherein the rotors are of uniform radial cross-section along their axial lengths.

4. An engine as claimed in claim 3, wherein said recess and lobe extend straight in the axial direction.

5. An engine as claimed in claim 3, wherein said recess and lobe extend helically in the axial direction.

6. An engine as claimed in claim 1, wherein the speed of rotation of the first, recessed, rotor is lower than the speed of rotation of the second, lobed, rotor of the device by a ratio, less than 1:1, of whole numbers.

7. An engine as claimed in claim 6, wherein the first and second rotors have respectively equiangularly spaced recesses and lobes in the same ratio of number of recesses to number of lobes as the speed ratio, of the lobed rotor to the recessed rotor.

8. An engine as claimed in claim 7, wherein the first rotor has three equiangularly disposed recesses, and the second rotor has two diametrically opposed lobes, and the ratio of their speeds of rotation is 2:3.

9. An engine as claimed in claim 1, wherein two or more of said second, lobed, rotors intermesh with the same first, recessed, rotor.

10. An engine as claimed in claim 1, wherein each said opening in a first-rotor end surface comprises a rotor port offset radially from its respective recess and communicating therewith through a passage in the rotor.

11. An engine as claimed in claim 1, wherein the rotors are enclosed in a housing having first and second arcuate recesses which are coaxial respectively with the first and second rotors and which form a sliding seal therewith, such that for a portion of a turn before and/or after the lobe passes through the recess in the first rotor, there is defined between the rotors and the housing an additional transient chamber of progressively increasing or decreasing volume which communicates with the transient chamber between the rotors.

12. An engine as claimed in claim 1, wherein each said opening in a first-rotor end surface comprises the end of a chamfered groove in the respective recess surface.

* * * * *